United States Patent [19]

Johnson

[11] 4,296,291

[45] Oct. 20, 1981

[54] ELEVATOR CONTROL ADAPTOR FOR HANDICAPPED USERS

[76] Inventor: Lester E. Johnson, Rte. #2, Box 40, Glyndon, Minn. 56547

[21] Appl. No.: 115,487

[22] Filed: Jan. 25, 1980

[51] Int. Cl.[3] ..... H01H 3/20

[52] U.S. Cl. ..... 200/331; 200/332; 200/340

[58] Field of Search ..... 200/331, 332, 330, 340

[56] References Cited

U.S. PATENT DOCUMENTS

| | | | |
|---|---|---|---|
| 2,614,197 | 10/1952 | Lightfoot | 200/331 |
| 2,719,898 | 10/1955 | Allen | 200/331 |
| 3,024,339 | 3/1962 | Johnson | 200/331 |
| 3,081,390 | 3/1963 | Lasar | 200/332 |
| 3,264,443 | 8/1966 | Farina et al. | 200/331 |
| 3,581,037 | 5/1971 | Schiffelbein | 200/331 |
| 3,722,319 | 3/1973 | Reznik et al. | 200/331 |
| 3,839,615 | 10/1974 | Bradford | 200/331 |
| 3,911,752 | 10/1975 | Olson | 200/331 |
| 3,939,725 | 2/1976 | Fisher | 200/331 |

FOREIGN PATENT DOCUMENTS

| | | | |
|---|---|---|---|
| 316604 | 4/1934 | Italy | 200/331 |

*Primary Examiner*—Willis Little

*Attorney, Agent, or Firm*—Merchant, Gould, Smith, Edell, Welter & Schmidt

[57] ABSTRACT

An apparatus (10) for adapting the primary control button (23) in an elevator control panel (4) for use by handicapped people who are not able to normally reach the buttons (1–3). Apparatus (10) includes an auxiliary control panel (12) which mounts a plurality of auxiliary buttons (1*a*–3*a*). A first link arm (28) connects each of the auxiliary buttons (1*a*–3*a*) to one end of a pivot rod 22. A second link arm (30) connects the other end of the pivot rod 22 to a false primary button (1*f*–3*f*) located immediately in front of the primary buttons (1–3). The primary buttons can be actuated either by pushing inwardly on the false primary buttons (1*f*–3*f*) or by pushing inwardly on the auxiliary buttons (1–3) and causing rotation of the pivot rods (22).

16 Claims, 8 Drawing Figures

ELEVATOR CONTROL ADAPTOR FOR HANDICAPPED USERS

TECHNICAL FIELD

This invention relates to an elevator system of the self-service type in which the elevator cars are controlled by the users of the system. More particularly, this invention relates to a method and an apparatus for converting or adapting the normal elevator controls, both the floor buttons and the car control buttons, for use by handicapped or other people who are unable to easily reach the location of the controls. More generally, this invention relates to an apparatus for the remote actuation of a push button type switch.

DESCRIPTION OF THE PRIOR ART

Elevator systems of the self-service type are widely known. Such a system is customarily installed in a multi-story building for transporting people and objects from one floor to another. A self-service elevator system is characterized by the absense of an elevator operator inside each of the cars. Rather, the passengers themselves control the operation of the cars.

A self-service elevator system usually has two types of control buttons which are actuable by the passengers. The first type will be referred to as the floor buttons and comprise directional "up" and "down" buttons on each floor of the building. The appropriate button is actuated depending on whether the passenger wishes to go up or down in the building. The second type of control buttons will be referred to as the car control buttons. The car control buttons are located inside the elevator car and comprise a plurality of numbered buttons which correspond to the number of floors in the building. Extra buttons, such as an alarm button or a door open button, may also be included in the car control buttons. Once a passenger enters the elevator car, he pushes the numbered button which corresponds to the floor to which he desired to travel.

In many self-service elevator systems, the car control buttons, and often the floor buttons as well, are located at a height which is appropriate for actuation by a normal person. People who are extremely short as well as people who are disabled and confined to a wheelchair are often not able to reach the bottons to actuate them. Such people must either have a companion to actuate the buttons or must wait for someone to come along and assist them. As to such users, this obviously defeats the purpose of a self service elevator system. Moreover, governmental regulations now require that the controls of a self-service elevator system be easily usable by people confined to wheelchairs. Accordingly, there is a demonstrated need for an invention which would allow handicapped users to actuate the normal control buttons of an elevator system. However, prior to the present invention and to the best of Applicant's knowledge, no such device existed.

Various devices have been proposes to allow small children or disabled people to actuate a light switch. Generally, such devices include an elongated rod which hangs downwardly from the switch and which is coupled to the switch. The switch may be thrown by pulling up or down on the rod. U.S. Pat. Nos. 2,719,898 and 3,581,037 are examples of such devices.

As useful as the above-noted devices may be for throwing light switches, they are not suitable, and have never been proposed to the best of Applicant's knowledge, for adapting elevator control buttons for use by handicapped people. Since many elevator control buttons are heat sensitive or push button type switches as opposed to a throw type of switch, the above-noted devices would not be operable for the actuation of the control buttons. They are designed only for use with throw type switches.

Italian Pat. No. 316,604 discloses a device which apparently relates to the remote actuation of a push button type switch. This device comprises a crank arm having one leg in contact with the push button switch and a downwardly depending chain attached to the other leg. Pulling on the chain will rotate the crank arm inwardly to actuate the push button. However, the use of a plurality of downwardly extending chains hanging from the normal buttons of an elevator control system do not comprise a workable solution to the problems previously posed. Such chains would soon be entangled, vandalized or removed rendering the adaptation useless.

SUMMARY OF THE INVENTION

One aspect of this invention relates to a method and apparatus for converting or adapting the controls of an elevator system for use by persons who are unable to reach the normal controls.

Another aspect of this invention relates to an improved apparatus for the remote actuation of a push button switch.

The method of this invention comprises establishing generally adjacent to each set of floor and car control buttons in an elevator system an array of auxiliary buttons which equal in number the buttons in the adjacent set. The auxiliary buttons in each array are located at a height which is easily reached by the persons who are unable to otherwise reach the normal floor and car control buttons. Each of the auxiliary buttons in each array is operatively connected to a corresponding one of the buttons in the adjacent set such that actuation of an auxiliary button actuates the corresponding button in the adjacent set. Furthermore, all of the floor and car control buttons are allowed to be individually operable in a normal manner by other persons who can easily reach these buttons.

An apparatus according to this invention for adapting an elevator control panel for use by operators who are unable to easily reach the elevator control panel comprises an auxiliary control panel mounted generally adjacent the elevator control panel. At least one selectively actuable auxiliary control button is mounted in the auxiliary control panel. The auxiliary button is mounted at an elevation which is different from that of a primary button in the elevator control panel and which is more easily reached by the operators. Means is provided for converting actuation of the auxiliary button to actuation of the primary button, whereby the primary button is actuated from a remote location defined by the auxiliary button.

More generally, an apparatus according to this invention is usable for the remote actuation of any push button switch which includes an inwardly movable push button that actuates an underlying switch means. The apparatus includes an auxiliary push button mounted in a remote location. Means is provided for mounting the auxiliary push button for an inward actuating movement that is substantially identical to the actuating movement of the push button. In addition, means is provided for transmitting the inward actuating movement of the auxiliary push button to the face of the push button for actuation of the same.

BRIEF DESCRIPTION OF THE DRAWINGS

This invention will be described in more detail hereafter, when taken in conjunction with the following drawings, in which like reference numerals refer to like elements throughout.

DETAILED DESCRIPTION

Referring first to FIGS. 1–4, an apparatus according to this invention, for adapting the controls of a self-service elevator system for easy use by persons who are unable to normally reach the controls, is generally illustrated as 10. Apparatus 10 is illustrated with a substantially planar elevator control panel 4 located inside one of the elevator cars in the system. Control panel 4 includes a plurality of car control buttons 1–3, labeled 1, 2, and 3, which correspond to certain floors of the building serviced by the elevator car. Normally, a person of normal height has no trouble in reaching and actuating the control buttons 1–3. Buttons 1–3 will be referred to as the primary buttons hereafter because they are the buttons which form part of the original equipment of the elevator system. However, very short people or handicapped people confined to wheel chairs often cannot reach the primary control buttons 1–3 to actuate them. Apparatus 10 addresses itself to solving this problem by effectively allowing such users to actuate primary buttons 1–3.

While apparatus 10 is illustrated for use with the car control buttons 1–3 elevator control panel 4, it is not limited for such use. Indeed, apparatus 10 is meant to be usable with all of the control buttons in a self-service elevator system, both the car control buttons in the elevator cars themselves along with the floor buttons on each of the floors of the building serviced by the elevator. The floor buttons comprise the directional "up" or "down" buttons located on each floor of the building for summoning an upwardly or downwardly moving car to that floor. Moreover, the arrangement of buttons, of either the floor buttons or the car control buttons, can obviously vary in both number and arrangement from that illustrated in FIGS. 1–4. Typically, the control buttons will, however, be arranged vertically spaced apart in a suitable array with either a single or double row of buttons in the car control buttons.

Figure 4:
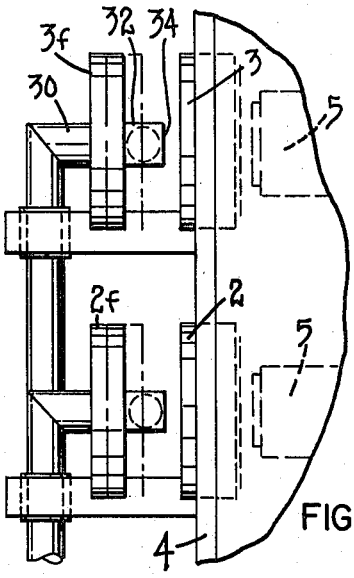
FIG. 4 is an enlarged side elevational view of a portion of the apparatus of FIG. 1, particularly illustrating the false primary button, the second link arm of the pivot rod and the manner in which they coact with the primary button for actuation of the same.

Referring now to FIG. 4, each of the primary buttons 1–3 typically of the push button type and are mounted in control panel 4 in any appropriate manner for push type actuation. An electrical switch 5 underlies and is normally spaced from each of the primary buttons 1–3 as shown in FIG. 4. Switch 5 is contacted and actuated by its corresponding primary button 1, 2 or 3 when the button is pushed inwardly by a force normal to the face of the button. The direction of such a force is illustrated by the arrows A in FIG. 4. Each switch 5 includes a spring return therein which returns the primary button 1, 2 or 3 to its normal unactuated position after release of the button.

Apparatus 10 according to this invention includes an auxiliary control panel 12. Control panel 12 is L-shaped having a first vertically extending portion 14 located along one side of elevator control panel 4 and a second horizontally extending portion 16 located beneath the bottom edge of elevator control panel 4. Horizontal portion 16 includes three auxiliary control buttons 1*a*, 2*a*, and 3*a* (the postscript "a" refers to auxiliary). A feature of apparatus 10 is that the number of auxiliary control buttons 1*a*, 2*a* and 3*a* correspond generally to the number of primary control buttons 1, 2 and 3 in the adjacent set of control buttons.

The auxiliary control buttons 1*a*–3*a* are vertically spaced apart in an array located generally beneath the primary buttons 1–3. Auxiliary buttons 1*a*–3*a* are labelled identically to primary buttons 1–3, that is with the numerals 1, 2, or 3 printed on the face of the buttons, but they are arranged in a reverse order, namely, the auxiliary button 1*a* labelled 1 is positioned above the auxiliary button 2*a* labelled 2 and so on. Each auxiliary button 1*a*–3*a* structurally comprises a circular face 18 located outside of auxiliary control panel 12. A stem 20 extends inwardly from the face 18 of each of the auxiliary buttons 1*a*–3*a* to a location inside of auxiliary control panel 12.

Each of the auxiliary buttons 1*a*–3*a* is mechanically linked or connected to a corresponding one of the buttons 1–3. This linkage is designed so that an inward actuating movement on any auxiliary button 1*a*–3*a* is transmitted to the corresponding primary button 1–3 for actuation of the primary button. Except for size and positioning the mechanical linkages between the auxiliary and primary buttons are identical. Therefore, only the linkage extending between auxiliary button 1*a* and primary button 1 will be described in detail. This description will, however, suffice to describe the other linkages as well.

Preferably, the mechanical linkage referred to above comprises a generally vertical and elongated pivot rod 22. Pivot rod 22 is as long as the vertical distance between the auxiliary and primary buttons 1*a* and 1. Pivot rod 22 is suitably journaled for rotation about an axis extending through its length by at least two vertically spaced apart bearing mounts 24 and 26. Bearing mounts 24 and 26 and pivot rod 22 are contained inside the vertically extending portion 14 of auxiliary control panel 12. Bearing mounts 24 and 26 are of any conventional design.

First and second link arms 28 and 30 extend laterally to one side from the lower and upper ends of pivot rod 22. First link arm 28 is contained inside the horizontal portion 16 of auxiliary control panel 12 and is fixedly secured, as by welding, to the stem 20 of auxiliary button 1*a*. The second link arm 30 at the upper end of pivot rod 22 extends out of the vertical portion 14 of control panel 12. Second link arm 30 has its "free" or outer end 32 positioned slightly above and immediately in front of the corresponding primary button 1. Outer end 32 of second link arm 30 is formed as a button actuating member having a planar face 34 opposed to the face of button 1.

The outer end 32 of second link arm 30 includes a false primary button 1F (the postscript "F" refers to false). False primary button 1F is the same size and shape as button 1 and is located immediately above primary button 1 to cover and hide button 1. See FIG. 1. The outer end 32 of second link arm 30 is located between the false primary button 1F and primary button 1. The purpose of false primary button 1F is to allow normal actuation of button 1 notwithstanding the interposition of second link arm 30.

Figure 1:
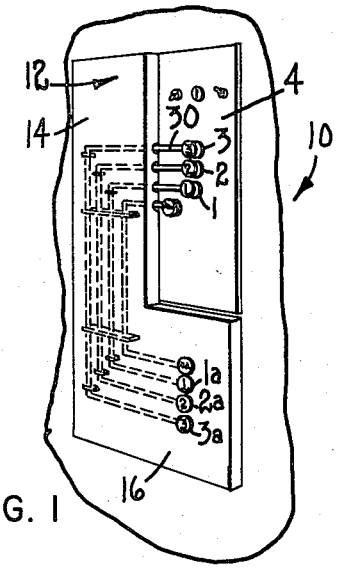
FIG. 1 is a partial perspective view of a set of car control buttons in a self-service elevator system, particularly illustrating an apparatus according to the present invention for adapting the car control buttons for use by operators who are unable to easily reach them.
Figure 2:
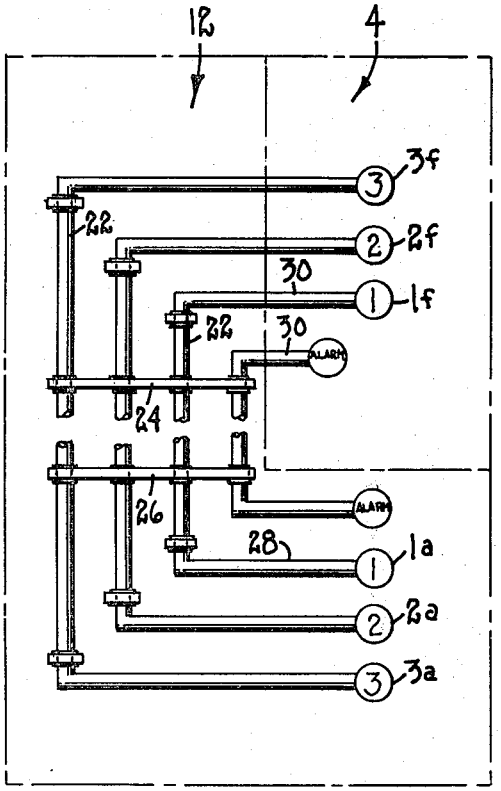
FIG. 2 is a diagrammatic plan view of the apparatus of FIG. 1.
Figure 3:
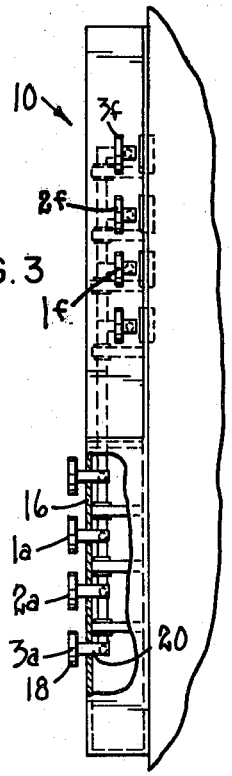
FIG. 3 is a side elevational view, partly broken away and shown in cross section, of the apparatus of FIG. 1.
Figure 5:
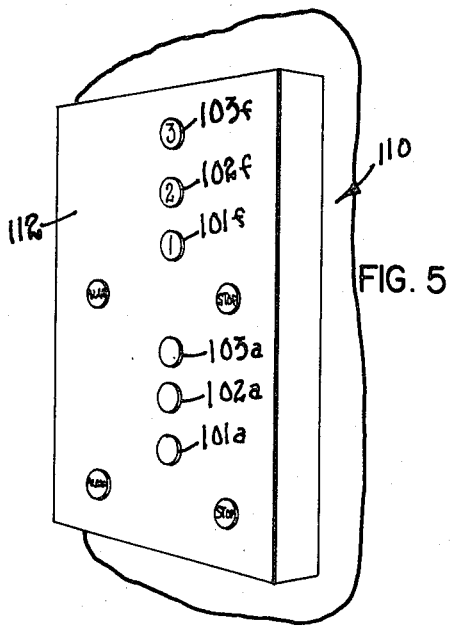
FIG. 5 is a perspective view of the car control buttons in a self-service elevator system, particularly illustrating a second embodiment of an apparatus according to this invention for adapting the car control buttons for use by operators who are unable to easily reach them.

Referring to FIGS. 1 and 2, the pivot rods 22 of each of the mechanical linkages between the corresponding primary and auxiliary buttons are identical except for different lengths which correspond to the different vertical distances between the sets of linked buttons. In addition, the mechanical linkages for the varying sets of linked buttons are nested together in the manner shown in FIG. 2 to avoid any interference with one another. This nesting ensures that no portion of one linkage crosses another linkage. While three primary buttons 1–3 and auxiliary buttons 1*a*–3*a* have been specifically discussed above, any other number of buttons could be coupled in the same way as noted earlier. For example, in FIG. 2, a similar coupling for a primary and an auxiliary alarm button is illustrated.

In the operation of apparatus 10, the auxiliary buttons 1*a*–3*a* are all located at an elevation in the elevator car substantally below that of the primary buttons 1–3. This elevation is selected to be sufficiently low such that a person seated in a wheel chair would have no trouble in reaching any of the auxiliary buttons 1*a*–3*a*. Thus, assuming that a person confined to a wheel chair, or a short person, enters the elevator car and wishes to actuate primary button 1, all that is required is that the auxiliary button 1*a* be pushed inwardly. This rotates pivot rod 22 in a counterclockwise motion about its axis as indicated by the arrow B. Such rotation causes the second link arm 30 to rotate towards the button 1. The outer end 32 of second link arm 30 will engage primary button 1 and push the button inwardly to actuate the underlying switch. When the user releases auxiliary button 1*a*, the spring return in switch 5, acting through button 1 on second link arm 30, will return the pivot rod to its normal unrotated position.

Apparatus 10 is advantageous since a handicapped user is able to actuate primary button 1 even though he would not normally have been able to reach that button by virtue of auxiliary button 1*a*. When an array of auxiliary buttons similar to that described in apparatus 10 is located next to each array of primary buttons in the elevator system, both the floor buttons and all the car control buttons in the elevator cars, the use of apparatus 10 renders the elevator system truly self-service for all users. A handicapped person no longer needs the aid of another person to operate the elevator system. In addition, apparatus 10 as described herein can be easily retrofitted to most existing elevator installations simply by installing auxiliary control panel 12 and the rest of the apparatus adjacent the regular elevator control panel 4. No extensive reworking of the elevator system, such as tearing the elevator car apart to mount control panel 4 in a lower location, is required. Thus, apparatus 10 accomplishes the purpose of adapting the elevator control system for use by a handicapped person in a relatively inexpensive manner.

One desirable feature of apparatus 10 is that the primary buttons 1–3 are still fully operable by a person of normal height. In this regard, a person of normal height entering the elevator car can actuate any of the primary buttons 1–3 simply by pushing inwardly on the corresponding false primary buttons 1F–3F. Therefore, the normal functioning of the elevator control system has not been changed even though it has been rendered more easily usable by handicapped persons.

While the placement of the auxiliary buttons 1*a*–3*a* has been illustrated as below that of the primary buttons 1–3, the relative positioning of these buttons could be reversed if the primary buttons 1–3 were placed relatively low in the elevator car such that actuation of the primary buttons was difficult for a person of normal height. In such a case, the person of normal height could be considered handicapped by virtue of having to bend down to actuate the primary buttons 1–3. In this latter event, the auxiliary buttons 1*a*–3*a* would be place above the primary buttons 1–3 convenient to the user of normal height.

Referring now to FIGS. 5–8, a second embodiment of an apparatus according to this invention will be illustrated generally as 110. Apparatus 110 operates on the same general principles and has structure which is similar to apparatus 4, but includes a number of improved features which may be preferred under certain conditions. To ease the task of description, components of apparatus 110 which have counterparts to components of apparatus 10 will be described with the same reference numerals with the addition of a "100" prefix.

Apparatus 110 includes an auxiliary control panel 112 which is rectangular and of the same width as elevator control panel 4. Auxiliary panel 112 fits entirely around and covers elevator control panel 4 although it also extends below control panel 4. In such a case, the auxiliary control panel 112 is more tamper proof than control panel 12 since in that embodiment the second link arms 30 extend out of panel 12. This access to the second link arms 30 gives a vandal the opportunity to bend or otherwise damage the link arms. Since control panel 112 now completely encloses second link arms 130 and mounts the false primary buttons 101F–103F, this opportunity to vandalize has been removed.

Figure 7:
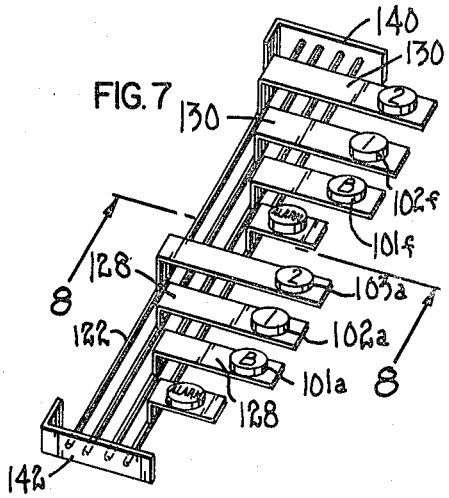
FIG. 7 is a perspective view of the mechanical linkage between the auxiliary and the false primary buttons of the apparatus of FIG. 5.
Figure 6:
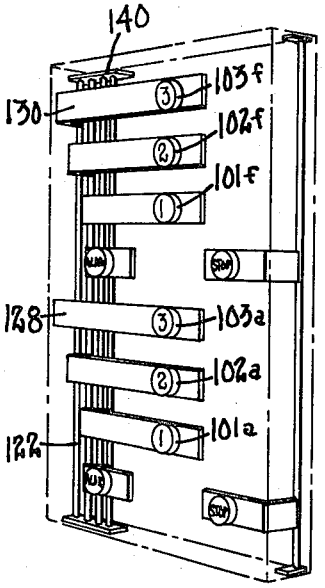
FIG. 6 is a diagrammatic perspective view of the apparatus of FIG. 5.
Figure 8:
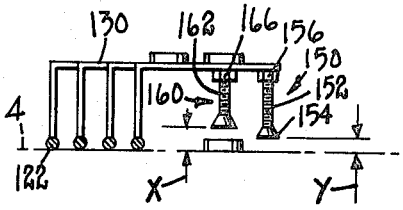
FIG. 8 is a cross-sectional view of the apparatus shown in FIG. 7, taken along lines 8—8 in FIG. 7, and particularly illustrating the adjustable button actuating member and abutment member on the second link arm.

In addition, an improved mechanical linkage extending between the auxiliary buttons 101*a*–103*a* and false primary buttons 101F–103F is illustrated in FIGS. 6 and 7. This mechanical linkage includes a plurality of closely spaced pivot rods 122. Pivot rods 122 are pivotably journaled in holes in top and bottom brackets 140 and 142. Top and bottom brackets 140 and 142 are removably secured by any suitable means to the top and bottom sides of auxiliary control panel 112. See FIG. 6. All the pivot rods 112 are now the same size extending the full length of control panel 122. This allows standardization in the manufacture of pivot rods 122.

Each of the first and second link arms 128 and 130 are now L-shaped such that the link arms project upwardly above the plane of pivot rods 122. The link arms 128 and 130 have different lengths with the same length of link arm being used for the same auxiliary and false primary buttons. For example, auxiliary button 101*a* and false primary button 101F are fixedly secured to link arms 128 and 130 of the same length. The downwardly depending flange 129 of these link arms is fixedly secured, as by welding, to the same pivot rod 122. Link arms 128 and 130 may be manufactured out of a flat metallic stock material to decrease the cost of apparatus 110.

The arrangement of mechanical linkages illustrated in FIGS. 5–8 allows the same order of auxiliary buttons 101*a*–103*a* to be used as is found in the primary buttons 101–103. Namely, button 101*a* is below button 102*a* just as button 101 is below button 102. This is advantageous since the same ordering of buttons is less confusing and more error free in operation than a reverse ordering as illustrated in FIGS. 1–4. Consequently, the type of mechanical linkages illustrated in this embodiment will generally be preferred although it is not critical.

Another feature illustrated in FIGS. 5–8, which can also be used in the embodiment of FIGS. 1–4, relates to use of an abutment member 105. A generally identical abutment member 150 extends downwardly from the outer end of each of the link arms 128 and 130. Abutment member 150 comprises a threaded securing member 152, such as a stove bolt or the like, threadedly secured to the outer end of link arms 128 and 130. The head 154 of securing member 152 is adapted to engage against the original elevator control panel 4 during rotation of pivot rod 122. Thus, abutment member 150 serves as a means for stopping rotation of the pivot rods 122 after a predetermined degree of travel. Abutment member 150 is threadedly adjustable relative to second link arm 130 simply by threading the member 150 in or out through a nut 156. Thus, the point at which head 154 engages against control panel 4 during rotation of pivot rod 122 can be adjusted.

In addition, each of the false primary buttons 101F–103F are fixedly secured, as by welding, to the second arms 130 directly above the primary buttons 101–103. A button actuating member 160 in the shape of a threaded securing member 162, such as a stove bolt, is secured to the underside of the second link arms 130 and extends rearwardly toward the primary button 101. Again, the button actuating member 160 is longitudinally adjustable relative to the second link arm by threading member 160 in or out through a nut 166. Thus, the button actuating member 160 can be adjusted to vary the effective position of the second link arm 18 relative to the primary button 101 in the unrotated position of pivot rod 122.

Preferably, in the unrotated position of pivot rod 122, the button actuating member 160 is located closely above primary button 101 by a distance which is generally labeled as "X". Also, in the unrotated position of rod 122, head 154 of abutment member 150 is located above control panel 4 by a distance referred to as "Y". Preferably, "Y" is slightly greater than "X" so that during rotation of pivot rod 122 the button actuating member 160 will first actuate primary button 101 by pushing inwardly on button 101 and then the abutment member 150 will substantially immediately thereafter engage control panel 4. This prevents damage to the switch 5 underlying button 101 which damage might occur if unrestricted travel of the pivot rod 122 was allowed. While abutment member 150 has been described for use on both the first and second link arms 128 and 130, presence of the abutment member 150 on only the second link arm 130 is essential.

Both apparatus 10 and 110 operate similarly. Both are advantageous since they allow a handicapped person who cannot easily reach the normal controls in the elevator to actuate these controls without the aid of another person. Thus, an elevator system equipped with either apparatus 10 or 110 is truly self-service.

Various modifications of this invention will be apparent to those skilled in the art. For example, if the primary buttons 1–3 are of the heat sensing type rather than the push button type, the same U-shaped mechanical linkage could be used. However, inward movement of the second link arm 30 or 130 would have to energize some type of heating element located on the face of the primary buttons 1–3. For example, the second link arm 30 or 130 could form part of a switch which is closed by contact with the primary button to cause energization of a heating element therein. This heating element would then cause actuation of the switch 5. Thus, the scope of this invention is to be limited only by the appended claims.

What is claimed is:

1. A method of making both the floor buttons and the car control buttons of a pre-installed self-service elevator system usable by persons unable to easily reach them, which comprises:

(a) establishing generally adjacent to each set of pre-installed floor and car control buttons an array of auxiliary buttons equal in number to the buttons in the adjacent set, wherein the auxiliary buttons in each array are located at a height which is easily reached by the persons who are unable to easily reach the floor and car control buttons;

(b) operatively connecting each of the auxiliary buttons in each array to a corresponding one of the buttons in the adjacent set by mechanically linking the auxiliary buttons to the corresponding buttons in the adjacent set such that an inward actuating movement on one of the auxiliary buttons translates through the mechanical linkage to an inwardly actuating movement to its corresponding button in the adjacent set; and (c) allowing all of the pre-installed floor and car control buttons to be individually operable in a normal manner by other persons who can easily reach these buttons.

2. The method according to claim 1, wherein the connecting step comprises mechanically linking the auxiliary buttons to the corresponding buttons in the adjacent set such that an inward actuating movement on one becomes an inward actuating movement on the other.

3. Apparatus for adapting a pre-installed elevator control panel for use by operators who are unable to easily reach the elevator control panel, wherein the elevator control panel includes at least one selectively actuable primary control button, which comprises:

(a) an auxiliary control panel mounted generally adjacent the elevator control panel;

(b) at least one selectively actuable auxiliary control button mounted in the auxiliary control panel, wherein the auxiliary button is mounted at an elevation which is different from that of the primary button and which is more easily reached by the operators; and (c) mechanical linkage means intermediate said primary and auxiliary buttons for converting actuation of the auxiliary button into actuation of the primary button, whereby the primary button is actuated from a remote location defined by the auxiliary button.

4. Apparatus as recited in claim 3, wherein the primary button is actuable in a normal manner by an operator who is easily able to reach the elevator control panel.

5. Apparatus as recited in claim 3, wherein both the primary and auxiliary buttons are of the push-button type actuated by an inward pushing movement on the face thereof, and wherein the converting means comprises a mechanical linkage extending between the auxiliary and primary buttons.

6. Apparatus as recited in claim 5, wherein the mechanical linkage comprises a pivot rod mounted in the auxiliary panel and having outwardly extending first and second link arms, wherein the first link arm is secured to the auxiliary button such that an inward actuating movement of the auxiliary button rotates the pivot rod, and wherein the second link arm extends in front of the primary button such that rotation of the pivot rod causes the second link arm to contact and actuate the primary button.

7. Apparatus as recited in claim 6, further including a false primary button on the second link arm for covering and hiding the primary button with the false primary button being spaced a small distance in front of the primary button in an unrotated position of the pivot rod, whereby the primary button is actuated either by actuation of the auxiliary button or the false primary button.

8. Apparatus as recited in claim 6, further including means for stopping the rotation of the pivot rod after a predetermined amount of rotation to prevent damage to the primary button.

9. Apparatus as recited in claim 8, wherein the rotation stopping means comprises an abutment member carried on the second link arm and extending toward the elevator control panel, wherein the abutment member is located on the second link arm to engage against the elevator control panel substantially immediately after actuation of the primary button.

10. Apparatus as recited in claim 9, wherein the abutment member is adjustable in the second link arm towards and away from the elevator control panel to vary the amount of rotation of the pivot rod before the abutment member engages the elevator control panel.

11. Apparatus as recited in claim 6, further including means for adjusting the position of the second link arm in front of the primary button in the unrotated position of the pivot rod.

12. Apparatus as recited in claim 11, wherein the second link arm includes a button actuating member that extends towards the primary button, and wherein the button actuating member is adjustable on the second link arm towards and away from the primary button.

13. Apparatus as recited in claims 3, 6, 8 or 11, further including a plurality of primary buttons on the elevator control panel and a plurality of auxiliary buttons in the auxiliary panel, wherein each of the auxiliary buttons is associated with one of the primary buttons for actuation of the primary button upon actuation of the auxiliary button.

14. Apparatus as recited in claim 13, wherein the primary and auxiliary buttons are vertically spaced apart in substantially identical arrays, and wherein any auxiliary button and its corresponding primary button are identically located in their respective arrays.

15. Apparatus as recited in claims 3 or 4, wherein the auxiliary control panel overlies and covers the elevator control panel, and further including at least one false primary button located in the auxiliary control panel overlying the primary button in the elevator control panel for actuation of the primary button in a normal manner by actuation of the false primary button.

16. An apparatus for actuating a push button type switch, werein the push button switch includes a switch means actuated by an inward movement of a push button having an activating force-receiving face, which comprises:

(a) an auxiliary push button mounted in a location remote from the location of the push button;

(b) means for mounting the auxiliary push button in a support structure for an inward actuating movement identical to the inward actuating movement of the push button; and (c) pivotable linkage means intermediate said push button and auxiliary push button for mechanically transmitting the inward actuating movement of the auxiliary push button to the face of the push button to actuate the same.

* * * * *